US006318030B1

(12) United States Patent
McClure et al.

(10) Patent No.: US 6,318,030 B1
(45) Date of Patent: Nov. 20, 2001

(54) DOUBLE DEPTH CRYPT VAULT

(75) Inventors: Ralph E. McClure; Eugene Jenkins, both of Sacramento, CA (US)

(73) Assignee: Paul Mains, Lodi, CA (US)

( * ) Notice: Subject to any disclaimer, the term of this patent is extended or adjusted under 35 U.S.C. 154(b) by 0 days.

(21) Appl. No.: 09/093,987

(22) Filed: Jun. 8, 1998

(51) Int. Cl.[7] ..... E04H 13/00

(52) U.S. Cl. ..... 52/136; 52/128; 52/136; 27/1; 27/27; 27/28; 27/35; 220/671

(58) Field of Search ..... 52/128, 136, 135, 52/137; 27/1, 35, 27, 28, 32, 33, 34; 220/651, 671, 529

(56) References Cited

U.S. PATENT DOCUMENTS 983,804 * 2/1911 Bermel ..... 52/128
1,691,568 * 11/1928 Gorman ..... 52/128
3,230,674 * 1/1966 Christensen ..... 52/128
3,287,865 * 11/1966 Lockman ..... 52/136
3,501,215 * 3/1970 Gartner ..... 52/136
4,288,952 * 9/1981 Work ..... 52/138
5,261,199 * 11/1993 Schmidt ..... 52/141
5,328,048 * 7/1994 Stein ..... 220/334
5,460,291 * 10/1995 Kerstiens ..... 220/629
5,746,030 * 5/1998 Sannipoli, Sr. ..... 52/136
5,860,549 * 1/1999 Allers et al. ..... 220/4.23
5,912,033 * 6/1999 Ferguson ..... 426/124

* cited by examiner

*Primary Examiner*—Carl D. Friedman
*Assistant Examiner*—Yvonne M. Horton
(74) *Attorney, Agent, or Firm*—Marc C. Jacobs

(57) ABSTRACT

A double depth crypt vault having two casket compartments, and which permits the placement of two caskets in the same crypt. A center dividing shelf separates the lower casket compartment from the upper casket compartment. The upper crypt compartment has a cover portion designated the vault lid which is configured to mate with and be sealed to the upper edge of the crypt vault. The double depth crypt vault can be formed and integrally molded as a unit out of a heavy-duty plastic material. Optionally, the double depth crypt vault may have tapered walls for added strength and stability for shipping purposes. Ground augers may be employed with the double depth crypt vault to prevent upward floatation.

9 Claims, 6 Drawing Sheets

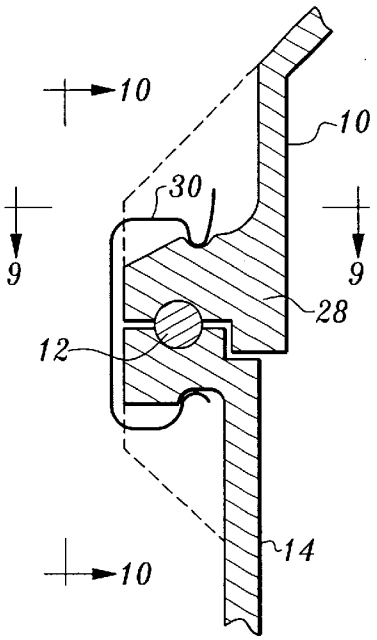
Fig. 12
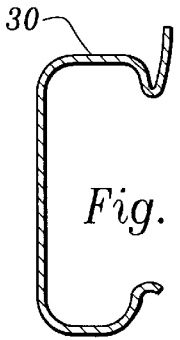
Fig. 11
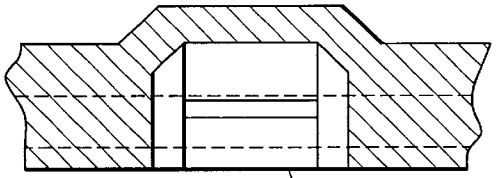
Fig. 9
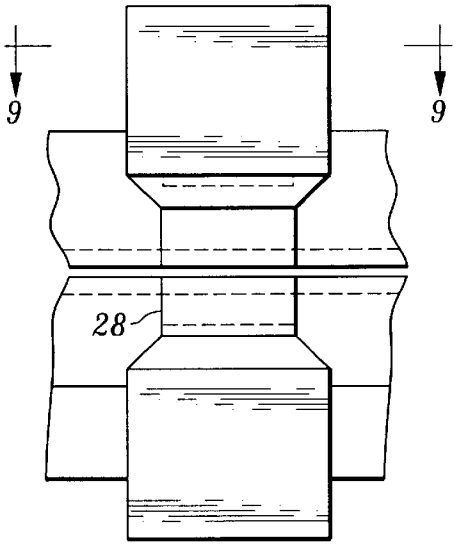
Fig. 10
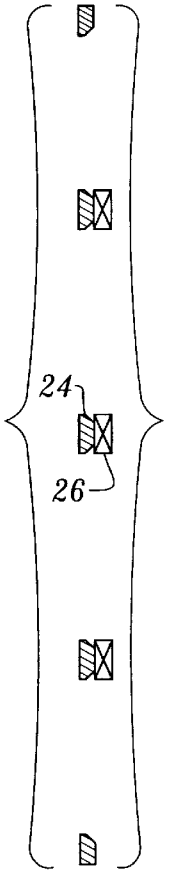
Fig. 8
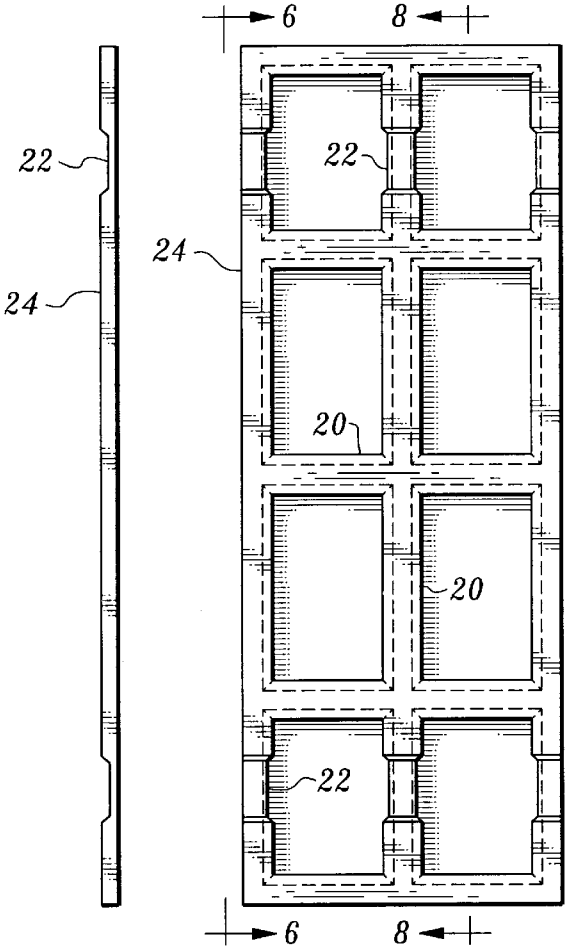
Fig. 7
Fig. 6

DOUBLE DEPTH CRYPT VAULT

BACKGROUND OF THE INVENTION

The present invention relates to an underground crypt having two horizontally spaced crypt compartments for two horizontally stacked caskets in one double depth crypt vault with a center dividing shelf to separate the two horizontally stacked caskets and sealed with a vault lid.

At the present time, it is becoming more feasible for cemeteries to use double depth lawn crypts so that two caskets in a single grave is possible. This provides greater utilization of land.

It is desirable to have one single crypt vault unit that can exert two stacked caskets that can be placed even next to a single burial if so desired.

The Center Dividing Shelf is for insuring that a second burial in the same grave opening will not disturb the casket of the first burial.

SUMMARY OF THE INVENTION

The present invention relates to a double depth single crypt vault with a diving shelf to separate the two horizontal caskets.

The present invention provides a fully sealed crypt vault lid that can be removed for the second burial and permanently sealed.

The present invention provides two ground augers with a shaft at each end of the double crypt vault that holds the double depth crypt vault in place when in the grave.

BRIEF DESCRIPTION OF THE DRAWINGS

FIG. 6 is an elevational view of a divider shelf as used herein.

FIG. 7 is a top plan view of the divider shelf.

FIG. 8 is a diagrammatic view of the placement of the element depicted in FIG. 7.

FIG. 9 is a top view of a portion of the inventive apparatus.

FIG. 10 is a side view of the lid portion of the invention.

FIG. 11 is an elevational view of a security clip employed herein.

FIG. 12 is a diagrammatic view of the engagement of two portions of the invention.

FIG. 15 is omitted.

In the drawings:

DETAILED DESCRIPTION OF THE PREFERRED EMBODIMENTS

Figure 1:
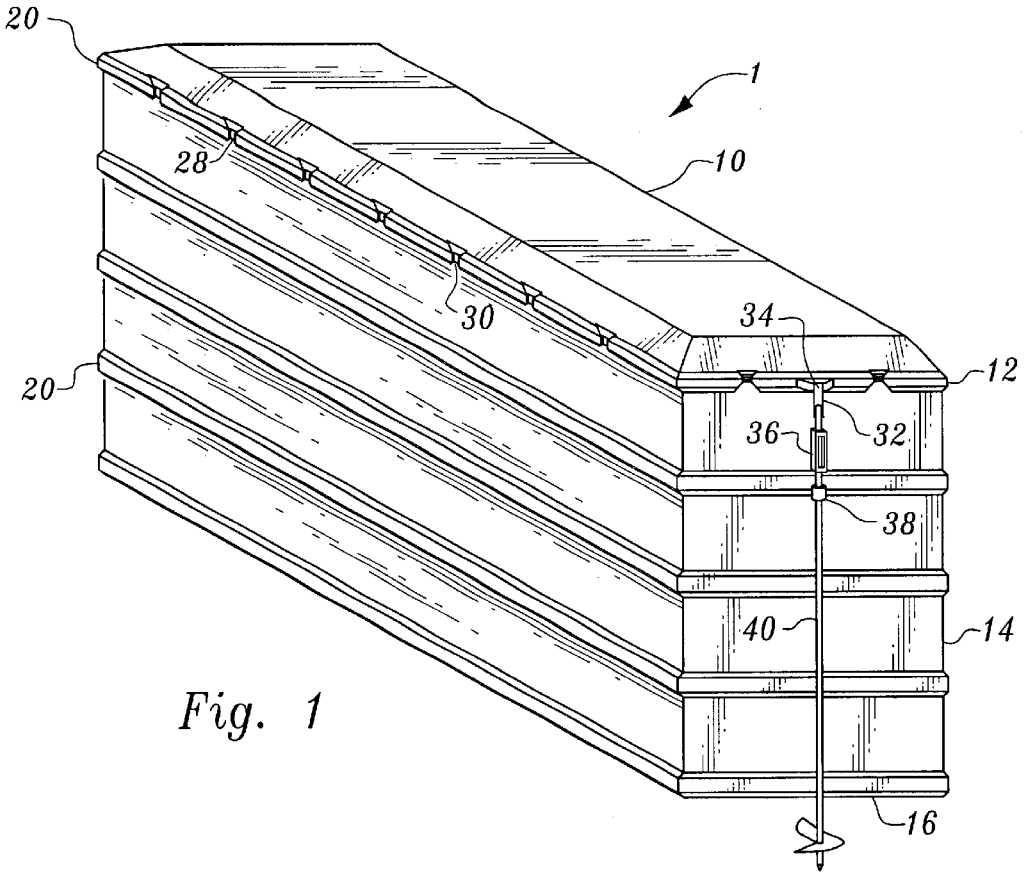
FIG. 1 is a perspective view of the double depth crypt vault of this invention.

FIG. 1 showing the present invention of a single unit double depth crypt vault 1 with support stiffeners ribs 20 and crypt vault lid 10 with security clips 30 securing the vault lid to the vault walls. As shown there is a ground auger 38 that is drilled into the lower portion of the ground below the vault to hold the vault in place. This is the assure that if the vault is pre-set in the ground with no caskets, the ground auger 38 will hold the double depth crypt vault in place.

Figure 2:
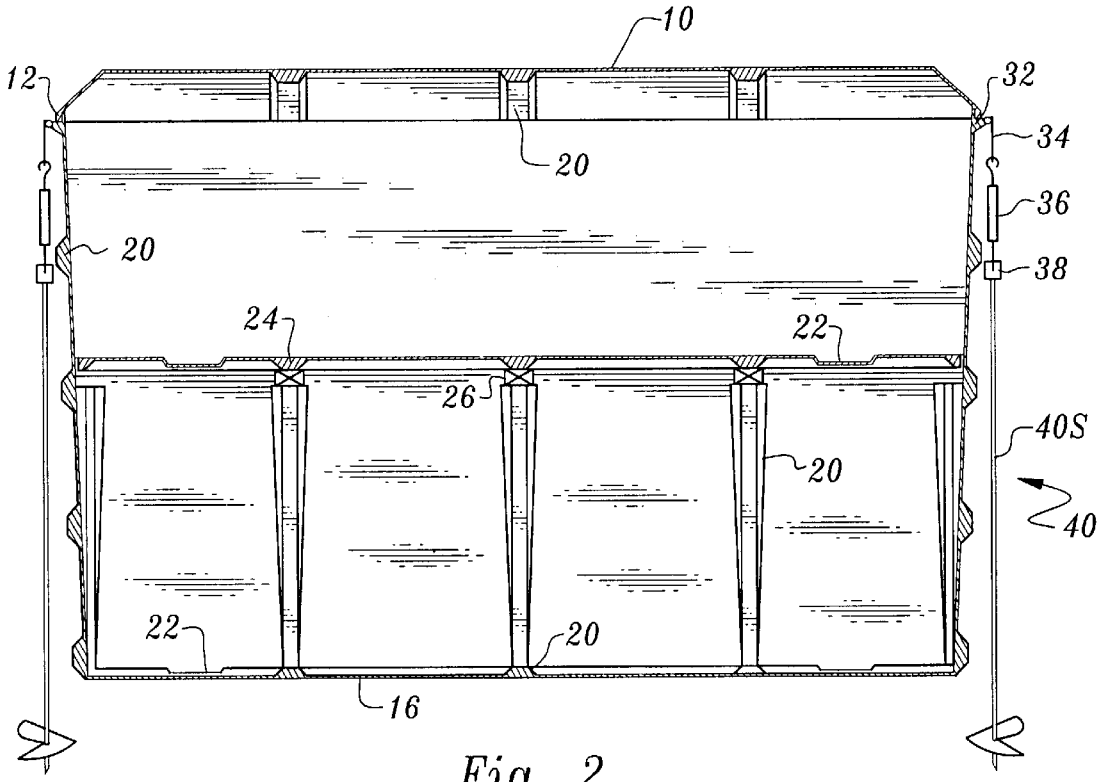
FIG. 2 is a sectional view thereof with a vault lid attached.

FIG. 2 showing the vault lid 10 and side view of double depth crypt vault with support stiffener ribs 20 along with indentation for lower straps 22 in the bottom of the vault 16 and in the center dividing shelf 24. Temporary support bars 26 hold up dividing shelf 24 and allows wall support against ground pressure of dirt. Rubber seal 12 for vault lid 10, extended support unit 32 that holds the top of the ground auger 40 unit in place. The tie down bracket 34 that connects to the top of turn buckle 36. The bottom of turn buckle 36 connects to auger plate 38 that is connected to ground auger shaft 40.

Figure 3:
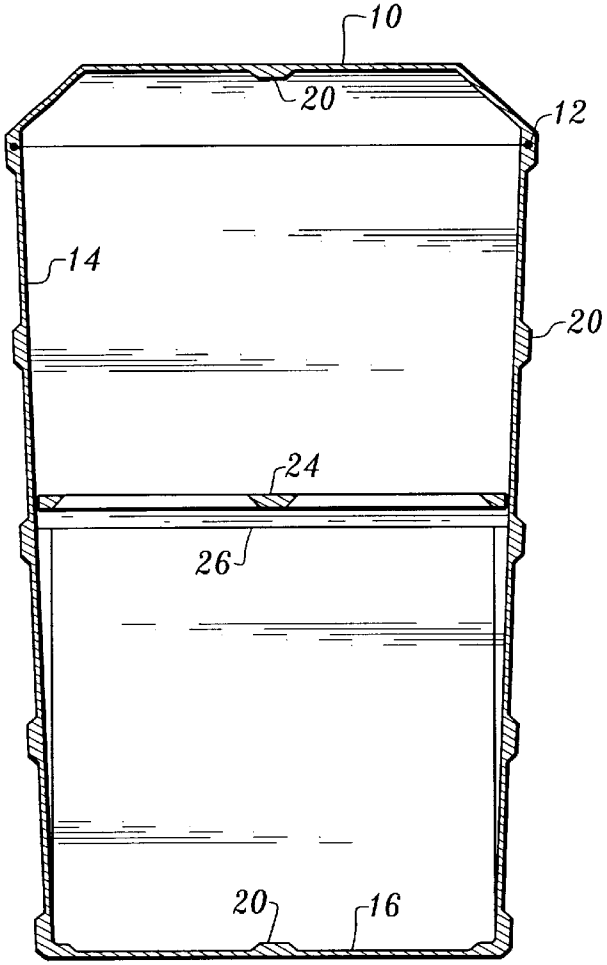
FIG. 3 is a front to back sectional view of the combined vault and lid.

FIG. 3 showing the end view of the present invention with support stiffener ribs 20 in the vault lid 10 and support stiffener ribs 20 in the vault walls 14 and vault bottom floor 16 also showing the center dividing shelf 24 resting on temporary support vas 26. There is a round rubber gasket seal 12 that surrounds the entire vault lid and mates with the top vault walls.

Figure 4:
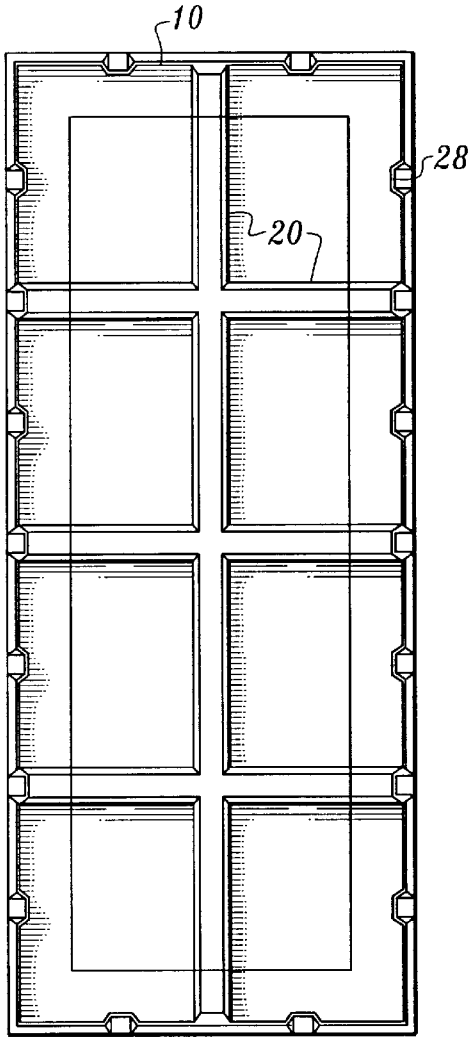
FIG. 4 is a top view of the vault lid.

FIG. 4 showing a top view of the vault lid 10 and the support stiffener ribs 20 along with the areas for secure clips 28 clip the lid to the vault walls.

Figure 5:
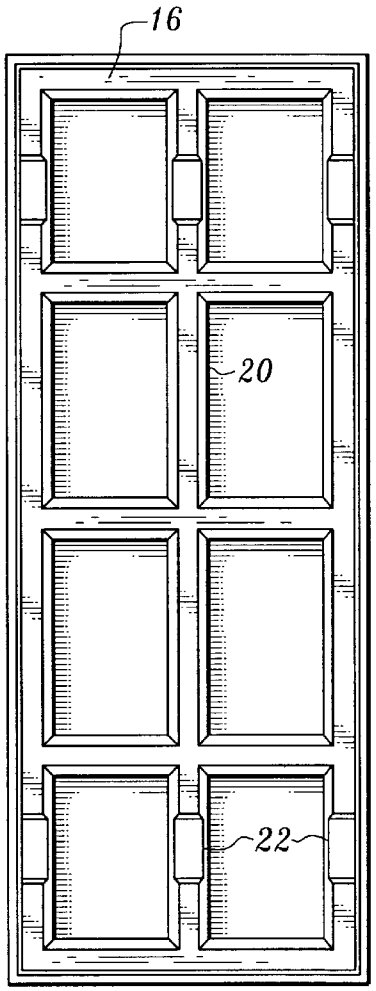
FIG. 5 is a top view of the vault floor.

FIG. 5 showing a top view of the vault floor 16 with support ribs 20 and indentions for lowering strap removal 22 and casket rest. FIG. 7 showing a top view of the vault center dividing shelf 24 along with support stiffener ribs 20 and indentations lowering straps 22.

FIG. 8 showing a top view of the center dividing shelf 24 resting on the temporary support bar 26.

FIG. 9 depicts a top view showing the area 28 that will hold security clips 30 to be used to.

FIG. 10 showing a side view of the vault lid. Mates the vault walls using the security clip area 28.

FIG. 11 showing an end view of a security clip 30 that holds the vault lid to the vault walls.

FIG. 12 showing an end view of the vault lid 10 resting on the vault walls 14 with the security clip area 28 above the vault wall 14 using a rubber seal 12 to seal and holding the vault lid 10 to the vault wall 14 is a security clip 30 that can be clipped in place as well as removed when the second burial takes place.

Figure 13:
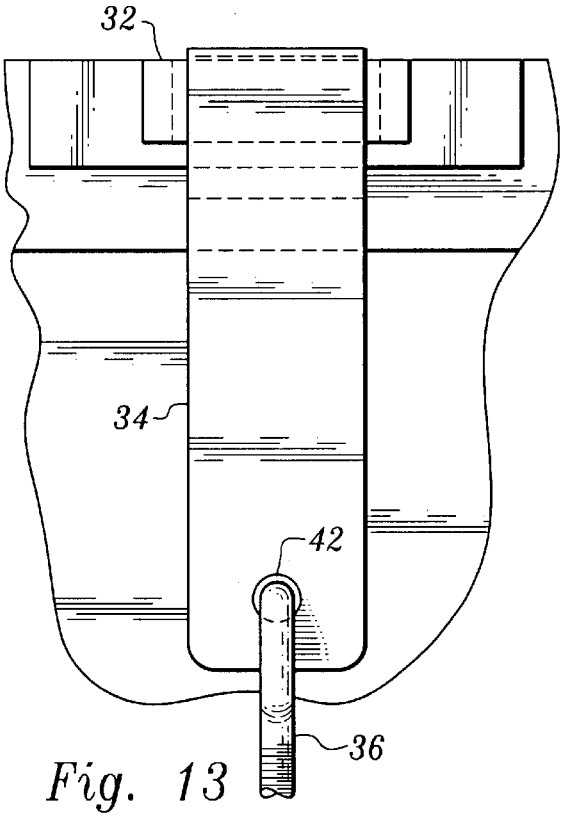
FIG. 13 is a side view of an element of this invention.

FIG. 13 is a flat side view of the tie down bracket 34 locking in place in the extended support unit 32 that is at the top of the vault wall along with the turn buckle hole 42 that allows the turn buckle 36 to be held in place.

Figure 14:
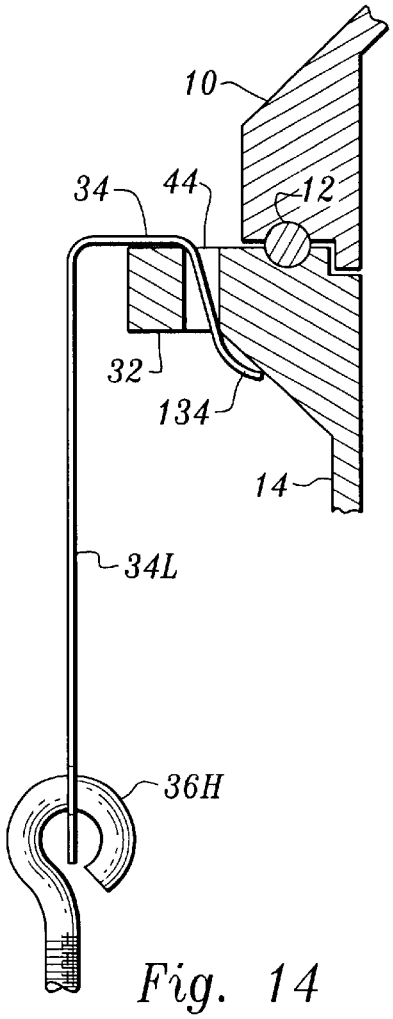
FIG. 14 is an end view of the element shown in FIG. 13.

FIG. 14 is an end view of the tie down bracket 34 that is placed on the end of the vault wall 14 that connects to the turn buckle 36. Also showing extended support unit 32 and how the tie down bracket 34 locks in place through the notched area 44 for the tie sown bracket 34. The vault 10 resting on the vault wall 14 with the rubber seal 12 sealing the vault lid 10 to the vault wall 14.

Figure 16:
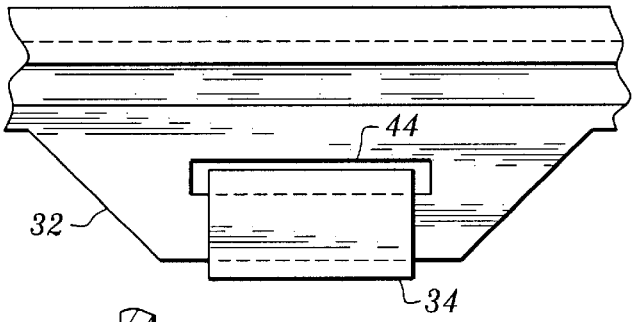
FIG. 16 is a top view of an element of a portion of the invention.

FIG. 16 is a top view of the rectangular opening 44. The notched area for the down bracket 34 that is at each end of the vault. The top of the vault wall in the extended support unit 32.

Figure 17:
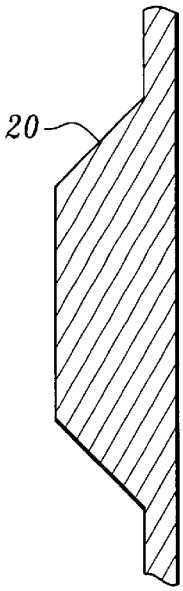
FIG. 17 is an end view of a stiffener rib as employed herein.

FIG. 17 showing an end view of the support stiffener rib 20 that is part of the vault walls and floor and vault lid and designed for added strength shown in FIGS. 1-2-3-4-5-7-12-17-24.

Figure 18:
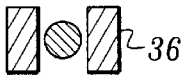
Fig. 18 (Prior Art)
FIG. 18 is a top plan view of a common turnbuckle.

FIG. 18 is a top view of the turn buckle 36. This turn buckle is designed to be connected to the auger that is on each end of the vault for the purpose of securing the vault in the ground after it is placed in the grave opening.

Figure 19:
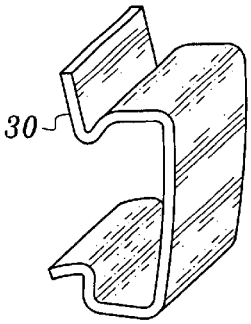
FIG. 19 is a side view of a security clip employed herein.

FIG. 19 is a side view of the security clip 30 that locks the vault lid to the vault walls. It can be unlocked when needed for the second burial.

Figure 20:
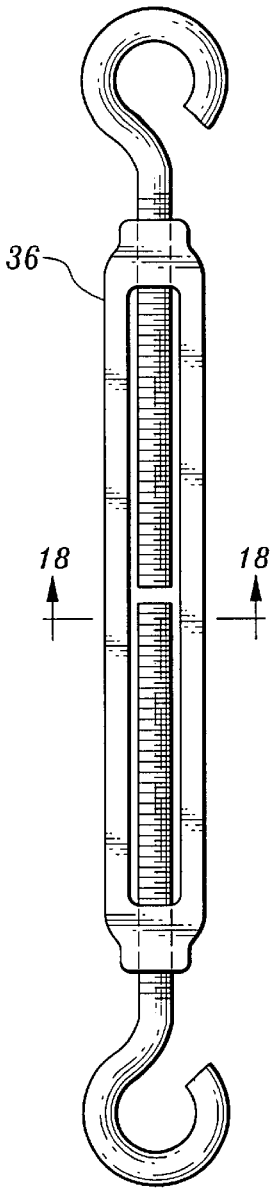
Fig. 20 (Prior Art)
FIG. 20 is an elevation view of a common turnbuckle.

FIG. 20 showing the turn buckle 36 that is used to secure the tie down bracket 34 and the auger shaft 40 together as shown also in FIGS. 1-2-13-14-22-23.

Figure 21:
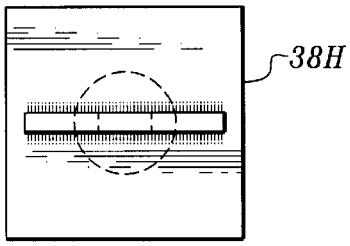
FIG. 21 is a top view of another element employed herein.

FIG. 21 showing a top view of the auger plate 38 that is attached to the bottom of the turn buckle 36.

Figure 22:
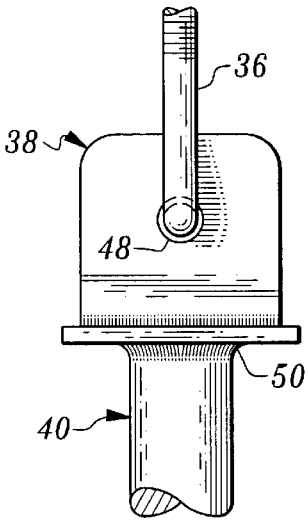
FIGS. 22 and 23 depict the turnbuckle-auger attachment from different points of view.
Figure 23:
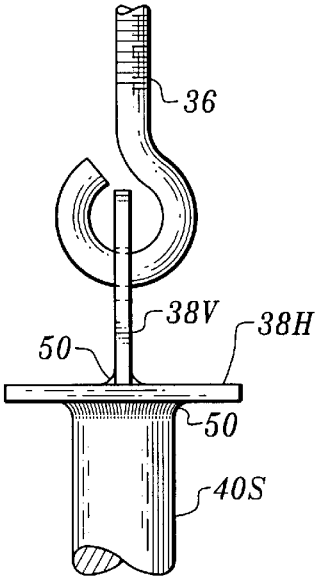

FIG. 22 shows a side view of the lower end of the turn buckle 36 attached to the auger mount plate 38's vertical section 38V via throughbore 48 in said vertical section. The horizontal section 38H is attached to the vertical section 38V by filet welds 50, and the horizontal section 38H is in turn welded to the auger shaft 40S.

Figure 24:
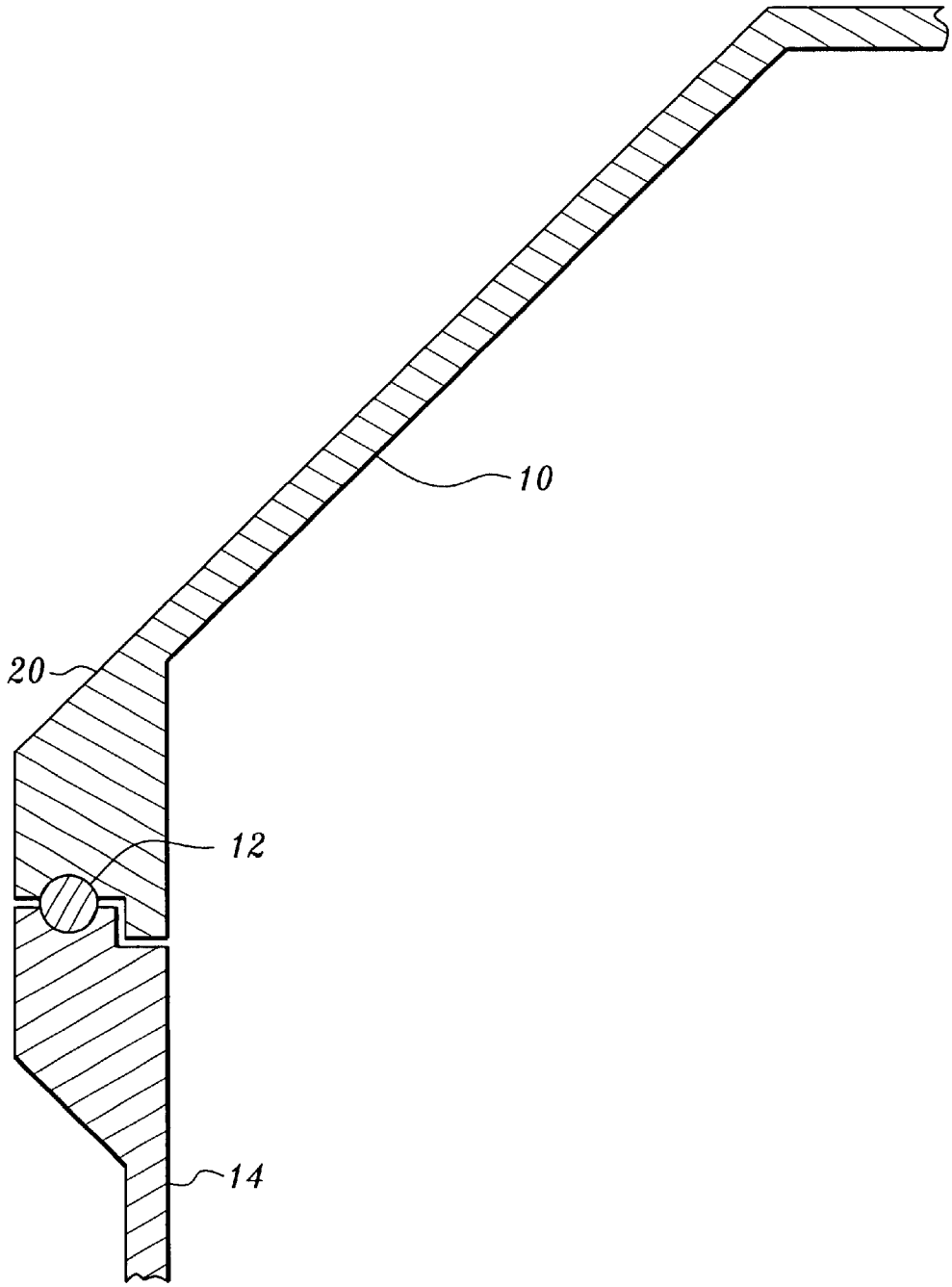
FIG. 24 is a diagrammatic view depicting the engagement of the vault lid and vault.

FIG. 24 showing an end view of the vault lid 10 mating with the vault wall 14 with support stiffener rib 20 for strength where the vault lid 10 mates with the vault wall 14 and in the center of the support stiffener rib 20 is a rubber seal 12 to assure a good seal.

What is claimed:

1. A double depth crypt vault having upper and lower crypt compartments, for providing two casket encryptments in one crypt vault for burying in the ground comprising:

a. a vault having upstanding sidewalls, a bottom wall and end walls, each of which walls has an interior surface and an exterior surface to define a lower crypt compartment to house a first coffin, the interior surface of said lower crypt compartment having a series of spaced stiffener ribs within the compartment on said side and end walls;

b. a removable shelf disposed upwardly from the bottom wall, said removable shelf being supported by said stiffener ribs of said lower crypt compartment's side and end walls, said removable shelf closing off the lower crypt compartment from;

c. an upper crypt compartment to house a second coffin having the same side and end walls as said first compartment, said removable base comprising of said upper compartment, whereby two coffins are capable of being buried in a single crypt vault, when a vault lid is applied to the top of the vault.

2. The crypt of claim 1 wherein the vault has tapered sidewalls from the top to the bottom of the crypt for added strength.

3. The crypt of claim 1 wherein at each end of said vault, a ground auger is attached to be drilled into the dirt below the bottom of the vault to secure the vault in place, to permit the vault to be pre-set in the grave before needed.

4. The double depth crypt vault of claim 1 further including a vault lid engageable with the vault and sealable thereto at spaced locations by security clips.

5. The crypt of claim 1 wherein the upstanding walls each include an outwardly directed flange portion, which flange portion has a convex channeled area for receipt of an O-ring.

6. The crypt vault of claim 1 wherein the vault is formed and integrally molded of plastic.

7. The double depth crypt vault of claim 5, further including a matingly engageable vault lid, coextensive in length and width as said vault; said lid having an outwardly directed flange portion which flange has a convex channeled area for receipt of an O-ring, which channeled area is aligned with the channeled area of said vault to facilitate the sealing of the interior of said vault when said lid is applied.

8. The double depth crypt vault of claim 7 wherein the flange portion of each of the vault and vault lid include a recess for the receipt of security clips.

9. The vault of claim 1 wherein each stiffener rib has similar rectangular upper and lower sections with a trapezoidal section having a diameter greater than the diameter of said rectangular sections, interposed therebetween.

* * * * *